US008876255B2

(12) United States Patent
Veis et al.

(10) Patent No.: US 8,876,255 B2
(45) Date of Patent: Nov. 4, 2014

(54) ORIFICE STRUCTURE FOR FLUID EJECTION DEVICE AND METHOD OF FORMING SAME

(75) Inventors: Alex Veis, Kadima (IL); Tsuyoshi Yamashita, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/563,383

(22) Filed: Jul. 31, 2012

(65) Prior Publication Data

US 2014/0035998 A1 Feb. 6, 2014

(51) Int. Cl.
*B41J 2/135* (2006.01)
*B41J 2/16* (2006.01)
*B41J 2/14* (2006.01)

(52) U.S. Cl.
CPC . *B41J 2/1433* (2013.01); *B41J 2/16* (2013.01)
USPC ..... 347/45

(58) Field of Classification Search
USPC ..... 347/47, 45
See application file for complete search history.

(56) References Cited

U.S. PATENT DOCUMENTS

| | | | | |
|---|---|---|---|---|
| 5,798,778 | A * | 8/1998 | Kimura et al. | 347/45 |
| 5,815,177 | A | 9/1998 | Sasaki | |
| 5,949,454 | A * | 9/1999 | Nozawa et al. | 347/45 |
| 6,132,028 | A * | 10/2000 | Su et al. | 347/47 |
| 6,312,103 | B1 | 11/2001 | Haluzak | |
| 6,474,566 | B1 * | 11/2002 | Hirota et al. | 239/102.2 |
| 6,520,617 | B2 | 2/2003 | Blair | |
| 7,347,531 | B2 * | 3/2008 | Kachi | 347/45 |
| 7,357,482 | B2 * | 4/2008 | Sugahara | 347/40 |
| 7,861,409 | B2 | 1/2011 | Macler et al. | |
| 2002/0036674 | A1 * | 3/2002 | Silverbrook | 347/54 |
| 2004/0174411 | A1 * | 9/2004 | Sumiya et al. | 347/47 |
| 2007/0040870 | A1 * | 2/2007 | Lu et al. | 347/68 |
| 2008/0088669 | A1 * | 4/2008 | Shimura | 347/47 |
| 2008/0150998 | A1 * | 6/2008 | Okamura | 347/30 |
| 2009/0025635 | A1 | 1/2009 | Clark et al. | |
| 2011/0043569 | A1 * | 2/2011 | Xie | 347/44 |

FOREIGN PATENT DOCUMENTS

| | | | |
|---|---|---|---|
| EP | 0882593 | A1 | 9/1998 |
| JP | 2088247 | C | 9/1996 |
| JP | 2004230745 | A | 8/2004 |

OTHER PUBLICATIONS

Donigian, D.W. et al., "Ink Jet Dye Fixation and Coating Pigments," Coating/Papermakers Conference, 1998, 18 pgs., retrieved from < http://www.minteq.com/fileadmin/user_upload/smi/Publications/S-PA-AT-PB-24.pdf >.

* cited by examiner

*Primary Examiner* — Matthew Luu
*Assistant Examiner* — Patrick King

(57) ABSTRACT

An orifice structure for a fluid ejection device includes a surface, an orifice formed through the surface, a first region of the surface projecting from the orifice, and a second region of the surface surrounding the first region, with the first region having a first surface energy, and the second region having a second surface energy higher than the first surface energy.

3 Claims, 4 Drawing Sheets

ORIFICE STRUCTURE FOR FLUID EJECTION DEVICE AND METHOD OF FORMING SAME

BACKGROUND

Fluid ejection devices, such as printheads in inkjet printing systems, may use thermal resistors or piezoelectric material membranes as actuators within fluidic chambers to eject drops of fluid (e.g., ink) through a plurality of orifices (or nozzles) and toward a print medium, such as a sheet of paper, so as to print onto the print medium.

The orifices may be formed in an orifice layer or orifice plate of the printhead. In some instances, interaction between the ink and surfaces of the orifice layer or orifice plate, including, for example, a surface around the orifices, may cause undesired effects. For example, when ink drop firing energy is higher than designed, interaction between the drop and a respective orifice may lead to ink residuals, which may tend to collect on the surface around the orifice. In addition, ink mist which may develop between the printhead and the media may also tend to deposit on the surface around the orifice. Unfortunately, the collected or deposited ink may agglomerate into puddles, which may interfere with an ejected ink drop, or prevent an orifice from properly ejecting ink drops.

DETAILED DESCRIPTION

In the following detailed description, reference is made to the accompanying drawings which form a part hereof, and in which is shown by way of illustration specific examples in which the disclosure may be practiced. In this regard, directional terminology, such as "top," "bottom," "front," "back," "leading," "trailing," etc., is used with reference to the orientation of the Figure(s) being described. Because components of examples of the present disclosure can be positioned in a number of different orientations, the directional terminology is used for purposes of illustration and is in no way limiting. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Figure 1:
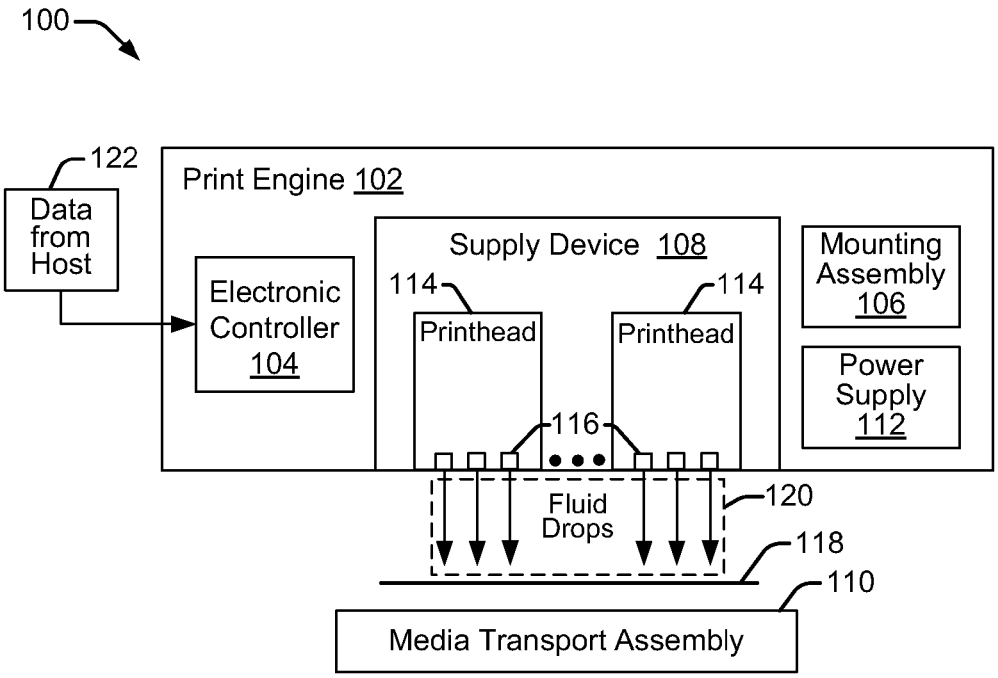
FIG. 1 is a block diagram illustrating one example of an inkjet printing system including a printhead implemented as an example of a fluid ejection device.

FIG. 1 is a block diagram illustrating one example of an inkjet printing system 100. In the illustrated example, inkjet printing system 100 includes a print engine 102 having a controller 104, a mounting assembly 106, one or more replaceable fluid supply devices 108 (e.g., print cartridges), a media transport assembly 110, and at least one power supply 112 that provides power to the various electrical components of inkjet printing system 100. Inkjet printing system 100 further includes one or more printheads 114 (i.e., fluid ejection devices) that eject droplets of ink or other fluid through a plurality of orifices 116 (also referred to as nozzles or bores) toward print media 118 so as to print onto print media 118. In one example, printhead 114 may be an integral part of an ink cartridge supply device 108, while in another example, printhead 114 may be mounted on a print bar (not shown) of mounting assembly 106 and coupled to a supply device 108 (e.g., via a tube). Print media 118 can be any type of suitable sheet or roll material, such as paper, card stock, transparencies, Mylar, polyester, plywood, foam board, fabric, canvas, and the like.

In one example, printhead 114 comprises a thermal inkjet (TIJ) printhead that ejects fluid drops from a respective orifice 116 by passing electrical current through a thermal resistor ejection element to generate heat and vaporize a small portion of the fluid within a firing chamber. In another example, printhead 114 comprises a piezoelectric inkjet (PIJ) printhead that uses a piezoelectric material ejection element to generate pressure pulses to force fluid drops out of a respective orifice 116. In either example, orifices 116 are typically arranged in one or more columns or arrays along printhead 114 such that properly sequenced ejection of ink from the orifices causes characters, symbols, and/or other graphics or images to be printed on print media 118 as printhead 114 and print media 118 are moved relative to each other.

Mounting assembly 106 positions printhead 114 relative to media transport assembly 110, and media transport assembly 110 positions print media 118 relative to printhead 114. Thus, a print zone 120 is defined adjacent to orifices 116 in an area between printhead 114 and print media 118. In one example, print engine 102 is a scanning type print engine. As such, mounting assembly 106 includes a carriage for moving printhead 114 relative to media transport assembly 110 to scan print media 118. In another example, print engine 102 is a non-scanning type print engine. As such, mounting assembly 106 fixes printhead 114 at a prescribed position relative to media transport assembly 110 while media transport assembly 110 positions print media 118 relative to printhead 114.

Electronic controller 104 typically includes components of a standard computing system such as a processor, memory, firmware, and other printer electronics for communicating with and controlling supply device 108, printhead(s) 114, mounting assembly 106, and media transport assembly 110. Electronic controller 104 receives data 122 from a host system, such as a computer, and temporarily stores the data 122 in a memory. Data 122 represents, for example, a document and/or file to be printed. As such, data 122 forms a print job for inkjet printing system 100 that includes one or more print job commands and/or command parameters. Using data 122, electronic controller 104 controls printhead 114 to eject ink drops from orifices 116 in a defined pattern that forms characters, symbols, and/or other graphics or images on print medium 118.

Figure 2:
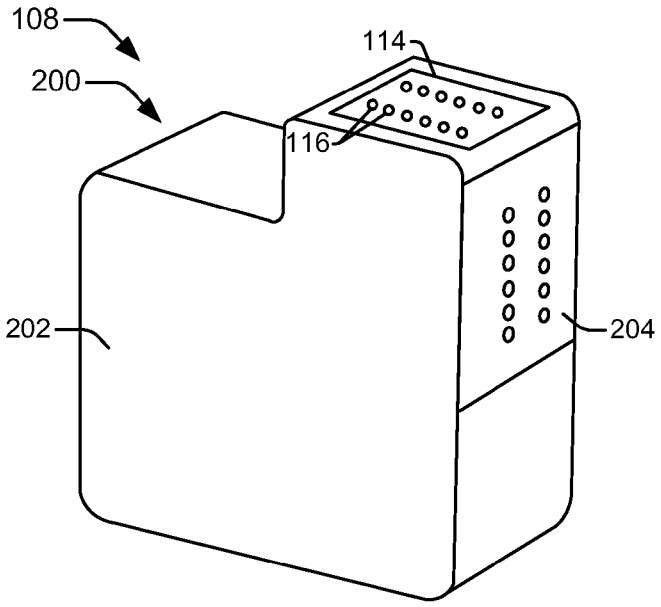
FIG. 2 is a schematic illustration of one example of a print cartridge implemented as an example of a fluid supply device for use in an inkjet printing system.

FIG. 2 is a schematic illustration of one example of a print cartridge 200 implemented as an example of fluid supply device 108 for use in inkjet printing system 100. Print cartridge 200 includes a cartridge body 202, printhead 114 (including orifices 116), and electrical contacts 204. Cartridge body 200 supports printhead 114 and electrical contacts 204 through which electrical signals are provided to activate ejection elements (e.g., resistive heating elements) that eject fluid drops from select orifices 116. Fluid within cartridge 200 can be any suitable fluid used in a printing process, such as various printable fluids, inks, pre-treatment compositions, fixers, and the like. In some examples, the fluid can be a fluid other than a printing fluid. Cartridge 200 may contain a fluid supply within cartridge body 200, but may also receive fluid from an external supply (not shown) such as a fluid reservoir connected through a tube, for example.

Figure 3:
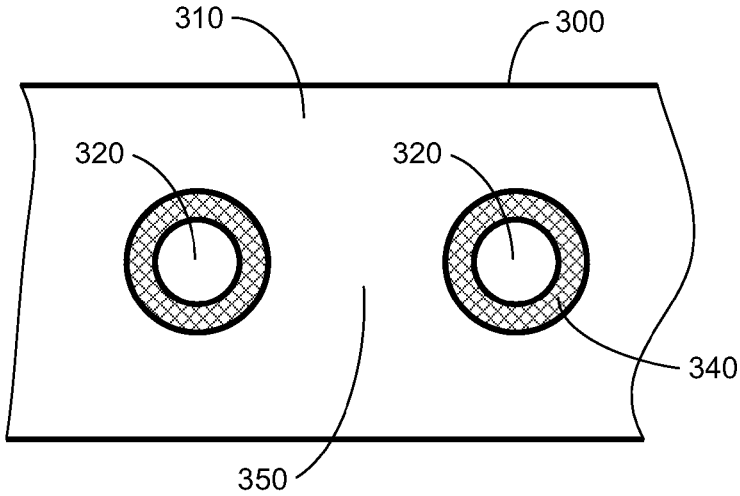
FIG. 3 is a schematic plan view illustrating one example of a portion of an orifice structure for a fluid ejection device.
Figure 4A:
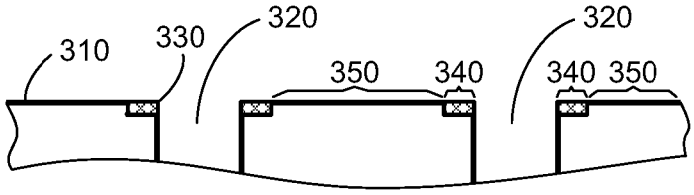
FIG. 4*a* is a schematic cross-sectional view illustrating one example of a portion of the orifice structure of FIG. 3.
Figure 4B:
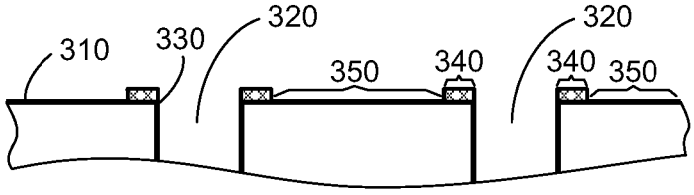
FIG. 4*b* is a schematic cross-sectional view illustrating another example of a portion of the orifice structure of FIG. 3.

FIGS. 3 and 4*a*-4*b* are schematic plan and cross-sectional views, respectively, illustrating one example of a portion of an orifice structure for a fluid ejection device. Orifice structure 300 includes a surface 310 and an array of orifices 320 formed or provided through surface 310. As described above, drops of fluid (e.g., ink) are ejected through or from orifices 320. In one example, surface 310 is formed by an orifice plate provided or positioned on a substrate or other supporting structure (not shown). In another example, surface 310 is formed by an orifice layer formed on or formed as part of a substrate or other supporting structure (not shown).

In one example, surface 310 of orifice structure 300 provides a surface energy gradient (or difference) to move or direct fluid away from a respective orifice 320. More specifically, in one implementation, the surface energy gradient is formed by providing different regions or areas of surface 310 with different surface energies. As such, the different surface energies provide surface 310 with different surface properties, namely different "wettability" characteristics. The wettability characteristics of surface 310 may vary, for example, between "wetting" and "non-wetting," wherein "wetting" means that the surface energy of surface 310 is greater than that of the fluid that is in contact with surface 310 (i.e., "high" surface energy), while "non-wetting" means that the surface energy of surface 310 is less than that of the fluid that is in contact with surface 310 (i.e., "low" surface energy). With these characteristics, fluid tends to bead on a "non-wetting" surface, and tends to spread on a "wetting" surface.

As illustrated in the example of FIGS. 3 and 4*a*-4*b*, surface 310 includes a first region 340 adjacent and surrounding a respective orifice 320, and a second region 350 surrounding first region 340. In one example, first region 340 has a first surface energy, and second region 350 has a second surface energy such that the relative surface energies of first region 340 and second region 350 produce the surface energy gradient of surface 310. More specifically, in one implementation, first region 340 has a "low" surface energy as compared to second region 350, and second region 350 has a "high" surface energy as compared to first region 340. Accordingly, the low surface energy of first region 340 deters or "rejects" the accumulation of fluid, and the high surface energy of second region 350 attracts or "draws" fluid such that fluid is directed or "pulled" away from a respective orifice 320 to second region 350.

In the example illustrated in FIGS. 3 and 4*a*-4*b*, first region 340 of surface 310 is concentric with a respective orifice 320. More specifically, in one example, first region 340 comprises a ring-shaped region, and has an inner diameter substantially coincident with (or within close proximity to) a circumference or perimeter of the respective orifice 320. As such, second region 350 of surface 310 includes a remaining area of surface 310 surrounding and beyond first region 340. For example, with first region 340 comprising a ring-shaped region, second region 350 includes a remaining area of surface 310 surrounding and beyond an outer diameter of the ring-shaped region.

The surface energy gradient of surface 310, including, for example, the relative surface energies of first region 340 and second region 350, may be formed by surface energy modification including, for example, photolithographic patterning, thin-film deposition, and/or surface treating. Photolithographic patterning includes, for example, patterning and etching of a deposited surface energy layer. Photolithographic patterning may also include lift-off processes. With thin-film deposition, thin-film layers with different properties and, therefore, different surface energies, can be deposited through CVD/PECVD, or through spin coating, spray coating, or a variety of other material deposition methods. Surface treating includes, for example, implanting a material that changes the surface energy, plasma or other treatments to selectively affect the surface termination and surface energy, or a damascene process wherein materials of different surface energy are deposited over topography such that grinding or CMP are used to expose the desired surface area structure.

FIG. 4*a* illustrates one example of a schematic cross-sectional view of orifice structure 300, with a respective orifice 320 extended through and communicated with surface 310. In one example, surface 310 and a perimeter of a respective orifice 320 meet to define an edge or interface 330 at surface 310. As described above, surface 310 includes first region 340 having a first surface energy (i.e., "low" surface energy), and second region 350 having a second surface energy (i.e., "high" surface energy).

As illustrated in the example of FIG. 4*a*, first region 340 is formed by depositing material in a recessed area (e.g., a trench formed by etching), and grinding or polishing (CMP) the deposited material to form surface 310, including first region 340 and second region 350, with a substantially uniform (i.e., substantially planar) surface. While surface 310, including first region 340 and second region 350, is illustrated as being substantially uniform (i.e., substantially planar), forming or producing the surface energy gradient of surface 310, including forming or producing first region 340 and/or second region 350, may introduce topography to surface 310.

FIG. 4*b* illustrates another example of a schematic cross-sectional view of orifice structure 300, with a respective orifice 320 extended through and communicated with surface 310. In one example, surface 310 and a perimeter of a respective orifice 320 meet to define an edge or interface 330 at surface 310. As described above, surface 310 includes first region 340 having a first surface energy (i.e., "low" surface energy), and second region 350 having a second surface energy (i.e., "high" surface energy). As illustrated in the example of FIG. 4*b*, first region 340 is formed by depositing material (e.g., thin-film deposition) on surface 310. As such, surface 310 includes a non-uniform surface as a result of the deposited material of first region 340. The extent of non-uniformity has been exaggerated for purposes of illustration.

Figure 5:
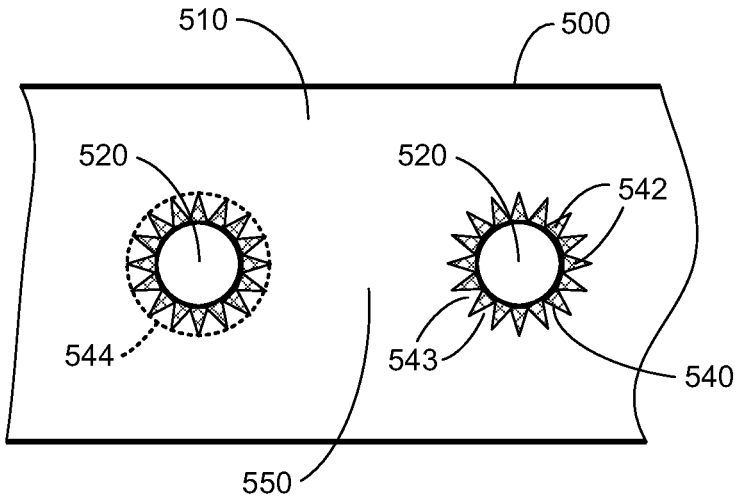
FIG. 5 is a schematic plan view illustrating another example of a portion of an orifice structure for a fluid ejection device.

FIG. 5 is a schematic plan view illustrating another example of a portion of an orifice structure for a fluid ejection device. Similar to orifice structure 300, orifice structure 500 includes a surface 510 and an array of orifices 520 formed or provided through surface 510 such that drops of fluid (e.g., ink) are ejected through or from orifices 520, as described above. Also similar to that described above, surface 510 is formed, for example, by an orifice plate or an orifice layer.

Similar to surface 310 of orifice structure 300, surface 510 of orifice structure 500 provides a surface energy gradient to move or direct fluid away from a respective orifice 520. As such, in one implementation, the surface energy gradient is formed by providing different regions or areas of surface 510 with different surface energies.

As illustrated in the example of FIG. 5, surface 510 includes a first region 540 adjacent and surrounding a respective orifice 520, and a second region 550 surrounding first region 540. In one example, first region 540 has a first surface energy, and second region 550 has a second surface energy such that the relative surface energies of first region 540 and second region 550 produce the surface energy gradient of surface 510. More specifically, in one implementation, first region 540 has a "low" surface energy as compared to second region 550, and second region 550 has a "high" surface energy as compared to first region 540. Accordingly, the low surface energy of first region 540 deters or "rejects" the accumulation of fluid, and the high surface energy of second region 550 attracts or "draws" fluid such that fluid is directed or "pulled" away from a respective orifice 520 to second region 550.

In the example illustrated in FIG. 5, first region 540 of orifice structure 500 projects or extends from a respective orifice 520 to a boundary concentric with the respective orifice 520, represented by broken line 544, and provides a patterned region of "low" surface energy. More specifically, in one example, first region 540 comprises a plurality of individual regions 542 each projecting or extending from a respective orifice 520 to boundary 544. As such, second region 550 of orifice structure 500 includes a remaining area of surface 510 surrounding and beyond first region 540, including corresponding regions 543 provided between individual regions 542. Individual regions 542 each have the first surface energy (i.e., "low" surface energy) and corresponding regions 543 each have the second surface energy (i.e., "high" surface energy), as described above. Accordingly, in one implementation, individual regions 542 and corresponding regions 543 cooperate to provide or form a plurality of individual "pathways" to direct or "pull" fluid away from the respective orifice 520 to second region 550. In this regard, the individual pathways provide virtual "channels" which create a pulling direction priority (i.e., capillary action) to "pull" fluid away from orifices 520 to second region 550.

In one implementation, individual regions 542 comprise a plurality of geometric-shaped regions each projecting or extending from a respective orifice 520. As such, corresponding inverse-shaped geometric regions (e.g., corresponding regions 543) are provided between the geometric-shaped regions. The geometric-shaped regions (and corresponding inverse-shaped geometric regions) are shaped so as to provide or form a plurality of individual "pathways" to channel fluid in a specific direction, including, more specifically, in a direction away from the respective orifice 520 to second region 550.

In one example, the geometric-shaped regions include triangular-shaped regions each having a base positioned around or along a perimeter of a respective orifice 520, and an altitude extended from the perimeter of the respective orifice 520. In one implementation, the base of each triangular-shaped region is oriented substantially perpendicular to an adjacent segment of the perimeter of the respective orifice 520 such that each triangular-shaped region projects or extends radially from a respective orifice 520. As such, each triangular-shaped region is arranged to channel fluid in a radial direction away from the respective orifice 520. While illustrated as being triangular in shape, it is understood that individual regions 542 may include other geometric-shaped regions, including, for example, trapezoidal-shaped regions.

Figure 6:
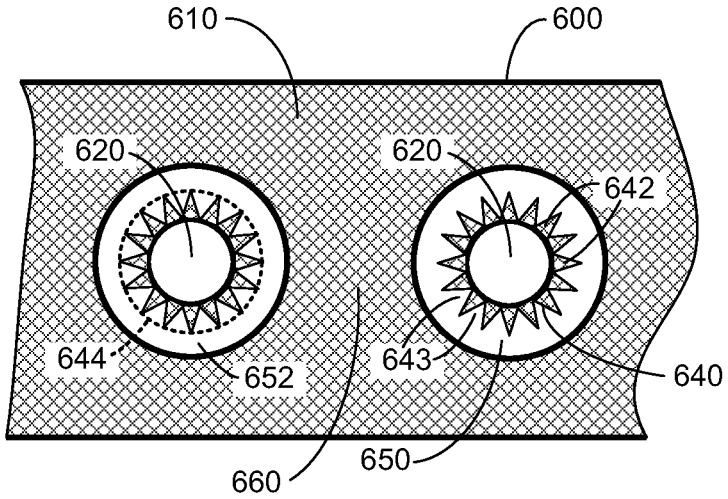
FIG. 6 is a schematic plan view illustrating another example of a portion of an orifice structure for a fluid ejection device.

FIG. 6 is a schematic plan view illustrating another example of a portion of an orifice structure for a fluid ejection device. Similar to orifice structure 300 and orifice structure 500, orifice structure 600 includes a surface 610 and an array of orifices 620 formed or provided through surface 610 such that drops of fluid (e.g., ink) are ejected through or from orifices 620, as described above. Also similar to that described above, surface 610 is formed, for example, by an orifice plate or an orifice layer.

Similar to surface 310 of orifice structure 300 and surface 510 of orifice structure 500, surface 610 of orifice structure 600 provides a surface energy gradient to move or direct fluid away from a respective orifice 620. As such, in one implementation, the surface energy gradient is formed by providing different regions or areas of surface 610 with different surface energies.

As illustrated in the example of FIG. 6, surface 610 includes a first region 640 adjacent and surrounding a respective orifice 620, a second region 650 surrounding first region 640, and a third region 660 surrounding second region 650. In one example, first region 640 has a first surface energy, second region 650 has a second surface energy, and third region 660 has a third surface energy such that the relative surface energies of first region 640, second region 650, and third region 660 produce the surface energy gradient of surface 610. More specifically, in one implementation, first region 640 has a "low" surface energy compared to second region 650, second region 650 has a "high" surface energy as compared to first region 640, and third region 660 has a "low" surface energy as compared to second region 650.

In one implementation, as represented in the example of FIG. 6, the surface energy of third region 660 is the same as (or substantially the same as) the surface energy of first region 640 such that first region 640 and third region 660 both have the same (or substantially the same) "low" surface energy. It is understood, however, that the surface energy of third region 660 may be different than the surface energy of first region 640 such that first region 640 and third region 660 each have a respective "low" surface energy as compared to second region 650.

With orifice structure 600, the low surface energy of first region 640 deters or "rejects" the accumulation of fluid, and the high surface energy of second region 650 attracts or "draws" fluid such that fluid is directed or "pulled" away from a respective orifice 610 to second region 650. In addition, the low surface energy of third region 660 also deters or "rejects" the accumulation of fluid such that fluid that is directed or "pulled" away from a respective orifice 620 is collected or "trapped" in second region 650. As such, in one implementation, second region 650 provides a fluid (e.g., ink) collection area. Accordingly, fluid (e.g., ink) collected in second region 650 may be removed, for example, using suction or vacuum knife servicing, and may be filtered and recycled.

In the example illustrated in FIG. 6, and similar to first region 540 of orifice structure 500, first region 640 of orifice structure 600 projects or extends from a respective orifice 620 to a boundary concentric with the respective orifice 620, represented by broken line 644, and provides a patterned region of "low" surface energy. More specifically, in one example, and similar to first region 540 of orifice structure 500, first region 640 of orifice structure 600 comprises a plurality of individual regions 642 each projecting or extending from a respective orifice 620 to boundary 644.

In one example, second region 650 of orifice structure 600 includes areas surrounding and beyond first region 640, including corresponding regions 643 provided between individual regions 642, and including a portion spaced from and concentric with a respective orifice 620. More specifically, in one implementation, in addition to corresponding regions 643 provided between individual regions 642, second region 650 includes a ring-shaped portion 652 having an inner diameter coinciding with boundary 644 of first region 640, and an outer diameter concentric with orifice 620. As such, third region 660 of orifice structure 600 includes a remaining area of surface 610 surrounding and beyond second region 650 including, more specifically, a remaining area of surface 610 surrounding and beyond the outer diameter of ring-shaped portion 652 of second region 650.

Similar to individual regions 542 of orifice structure 500, individual regions 642 of orifice structure 600 each have the first surface energy (i.e., "low" surface energy) and corresponding regions 643 each have the second surface energy (i.e., "high" surface energy), as described above. Accordingly, in one implementation, individual regions 642 and corresponding regions 643 cooperate to provide or form a plurality of individual "pathways" to direct or "pull" fluid away from the respective orifice 620 to second region 650. In this regard, the individual pathways provide virtual "channels" which create a pulling direction priority (i.e., capillary action) to "pull" fluid away from orifices 620 to second region 650.

In one implementation, similar to individual regions 542 of orifice structure 500, individual regions 642 of orifice structure 600 comprise a plurality of geometric-shaped regions each projecting or extending from a respective orifice 620. As such, corresponding inverse-shaped geometric regions (e.g., corresponding regions 643) are provided between the geometric-shaped regions. The geometric-shaped regions (and corresponding inverse-shaped geometric regions) are shaped so as to provide or form a plurality of individual "pathways" to channel fluid in a specific direction, including, more specifically, in a direction away from the respective orifice 620 to second region 650.

In one example, similar to individual regions 542 of orifice structure 500, the geometric-shaped regions of orifice structure 600 include triangular-shaped regions each including a base positioned around or along a perimeter of a respective orifice 620, and an altitude extended from the perimeter of the respective orifice 620. In one implementation, the base of each triangular-shaped region is oriented substantially perpendicular to an adjacent segment of the perimeter of the respective orifice 620 such that each triangular-shaped region projects or extends radially from a respective orifice 620. As such, each triangular-shaped region is arranged to channel fluid in a radial direction away from the respective orifice 620. While illustrated as being triangular in shape, it is understood that individual regions 642 may include other geometric-shaped regions, including, for example, trapezoidal-shaped regions.

Figure 7:
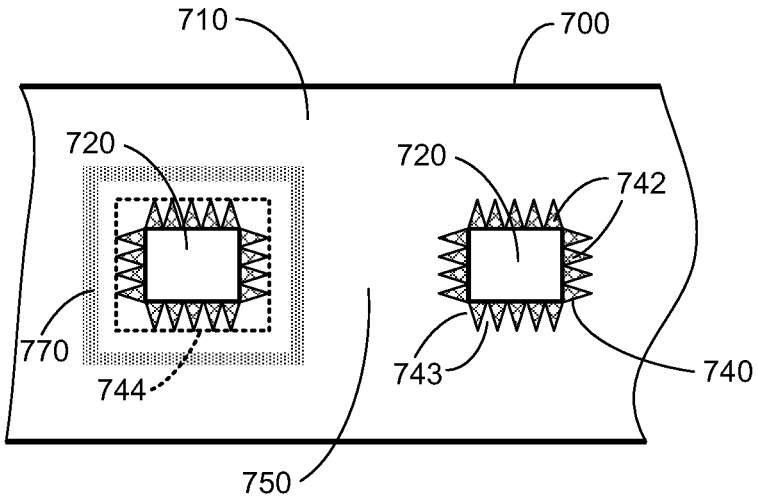
FIG. 7 is a schematic plan view illustrating another example of a portion of an orifice structure for a fluid ejection device.

FIG. 7 is a schematic plan view illustrating another example of a portion of an orifice structure for a fluid ejection device. Similar to orifice structures 300, 500, and 600, orifice structure 700 includes a surface 710 and an array of orifices 720 formed or provided through surface 710 such that drops of fluid (e.g., ink) are ejected through or from orifices 720, as described above. Also similar to that described above, surface 710 is formed, for example, by an orifice plate or an orifice layer. However, while orifices 320, 520, and 620 of respective orifice structures 300, 500, and 600 are circular in shape, orifices 720 of orifice structure 700 are rectangular in shape. In this regard, examples and implementations disclosed herein are applicable to orifices of various shapes (circular, oval, rectangular, square, etc.).

Similar to surfaces 310, 510, and 610 of respective orifice structures 300, 500, and 600, surface 710 of orifice structure 700 provides a surface energy gradient to move or direct fluid away from a respective orifice 720. As such, in one implementation, the surface energy gradient is formed by providing different regions or areas of surface 710 with different surface energies.

As illustrated in the example of FIG. 7, surface 710 includes a first region 740 adjacent and surrounding a respective orifice 720, and a second region 750 surrounding first region 740. In one example, first region 740 has a first surface energy, and second region 750 has a second surface energy such that the relative surface energies of first region 740 and second region 750 produce the surface energy gradient of surface 710. More specifically, in one implementation, first region 740 has a "low" surface energy as compared to second region 750, and second region 750 has a "high" surface energy as compared to first region 740. Accordingly, the low surface energy of first region 740 deters or "rejects" the accumulation of fluid, and the high surface energy of second region 750 attracts or "draws" fluid such that fluid is directed or "pulled" away from a respective orifice 720 to second region 750.

In one example, fluid (e.g., ink) within second region 750 is recycled. More specifically, in one implementation, a fluid collection area 770 is defined within second region 750 such that fluid (e.g., ink) collected within second region 750 may be removed or recovered at fluid collection area 770. Fluid (e.g., ink) may be removed or recovered using, for example, suction or vacuum knife servicing, and may be filtered for re-use. Such fluid (e.g., ink) recycling is also applicable to orifice structures 300, 500, and 600.

In the example illustrated in FIG. 7, and similar to first regions 540 and 640 of respective orifice structures 500 and 600, first region 740 of orifice structure 700 projects or extends from a respective orifice 720 to a boundary concentric with the respective orifice 720, represented by broken line 744, and provides a patterned region of "low" surface energy. More specifically, in one example, and similar to first regions 540 and 640 of respective orifice structures 500 and 600, first region 740 of orifice structure 700 comprises a plurality of individual regions 742 each projecting or extending from a respective orifice 720 to boundary 744. As such, second region 750 of orifice structure 700 includes a remaining area of surface 710 surrounding and beyond first region 740, including corresponding regions 743 provided between individual regions 742.

Similar to individual regions 542 and 642 of respective orifice structures 500 and 600, individual regions 742 of orifice structure 700 each have the first surface energy (i.e., "low" surface energy) and corresponding regions 743 each have the second surface energy (i.e., "high" surface energy), as described above. Accordingly, in one implementation, individual regions 742 and corresponding regions 743 cooperate to provide or form a plurality of individual "pathways" to direct or "pull" fluid away from the respective orifice 720 to second region 750. In this regard, the individual pathways provide virtual "channels" which create a pulling direction priority (i.e., capillary action) to "pull" fluid away from orifices 720 to second region 750.

In one implementation, similar to individual regions 542 and 642 of respective orifice structures 500 and 600, individual regions 742 of orifice structure 700 comprise a plurality of geometric-shaped regions each projecting or extending from a respective orifice 720. As such, corresponding inverse-shaped geometric regions (e.g., corresponding regions 743) are provided between the geometric-shaped regions. The geometric-shaped regions (and corresponding inverse-shaped geometric regions) are shaped so as to provide or form a plurality of individual "pathways" to channel fluid in a specific direction, including, more specifically, in a direction away from the respective orifice 720 to second region 750.

In one example, similar to individual regions 542 and 642 of respective orifice structures 500 and 600, the geometric-shaped regions of orifice structure 700 include triangular-shaped regions each including a base positioned around or along a perimeter of a respective orifice 720, and an altitude extended from the perimeter of the respective orifice 720. In one implementation, the base of each triangular-shaped region is oriented substantially perpendicular to an adjacent segment of the perimeter of the respective orifice 720 such that each triangular-shaped region projects or extends tangentially from a respective orifice 720. As such, each triangular-shaped region is arranged to channel fluid in a tangential direction away from the respective orifice 720. While illustrated as being triangular in shape, it is understood that individual regions 742 may include other geometric-shaped regions, including, for example, trapezoidal-shaped regions.

By providing surfaces 310, 510, 610, and 710 of respective orifice structures 300, 500, 600, and 700 with respective surface energy gradients, as described herein, removal of fluid (e.g., ink) in a specific direction, including, more specifically, in a direction away from respective orifices 320, 520, 620, and 720 may be facilitated. More specifically, by creating a boundary of low surface energy with preferred direction, respective areas or regions 340 and 350 of orifice structure 300, respective areas or regions 540 and 550 of orifice structure 500, respective areas or regions 640, 650, and 660 of orifice structure 600, and respective areas or regions 740 and 750 of orifice structure 700 direct or "pull" fluid (e.g., ink) away from respective orifices 320, 520, 620, and 720. In this regard, surface energies of orifice structures 300, 500, 600, and 700 may be tailored to provide respective "wiping"-like arrangements in an effort to keep areas adjacent or next to the respective orifices free of fluid (e.g., ink). In addition, with orifice structures 500, 600, and 700, the series of selected and organized geometric shapes enhance the action of the respective low surface energy regions or areas, thereby assisting in providing a type of in-situ wiping effect in an effort to keep the areas adjacent or next to the respective orifices free from fluid (e.g., ink).

By providing surfaces 310, 510, 610, and 710 of respective orifice structures 300, 500, 600, and 700 with respective surface energy gradients, as described herein, potentially undesirable ink-orifice interactions, including, for example, fluid (e.g., ink) puddle formation on the respective orifice surfaces, may be reduced or eliminated. Fluid (e.g., ink) puddle reduction or elimination may allow, for example, for faster ink refill speeds because trajectory errors associated with ink puddles are reduced. In addition, density non-uniformity may be reduced since coalescence of adjacent ink drops, which may lead to non-uniform density, may be reduced. Accordingly, orifice structures 300, 500, 600, and 700, as described herein, may contribute, for example, to reduced ink puddle formation, improved printing speed, improved print density uniformity, increased recycled ink quantities, and/or improved orifice (nozzle) health.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

What is claimed is:

1. An orifice structure for a fluid ejection device, comprising:

a surface;

an orifice formed through the surface;

a first region of the surface projecting from the orifice;

a second region of the surface surrounding the first region; and a third region of the surface surrounding the second region, the third region spaced from the first region, the first region having a first surface energy, the second region having a second surface energy higher than the first surface energy, and the third region having a third surface energy lower than the second surface energy, the first region comprising a plurality of triangular-shaped regions each including a base positioned along a perimeter of the orifice, and an altitude extended from the perimeter of the orifice.

2. The orifice structure of claim 1, wherein the first region includes an inner boundary adjacent and concentric with the orifice, and an outer boundary spaced from and concentric with the inner boundary.

3. The orifice structure of claim 1, wherein the second region includes an inner boundary and an outer boundary spaced from the inner boundary.

* * * * *